United States Patent [19]

Tufts

[11] Patent Number: 4,516,280

[45] Date of Patent: May 14, 1985

[54] WATER SAVING TOILET SYSTEM

[75] Inventor: Wesley M. Tufts, Holliston, Mass.

[73] Assignee: Control Fluidics, Inc., Greenwich, Conn.

[21] Appl. No.: 604,855

[22] Filed: Apr. 27, 1984

[51] Int. Cl.[3] ..... E03D 9/10

[52] U.S. Cl. ..... 4/319; 4/300; 4/321

[58] Field of Search ..... 4/319, 321, 300, 323, 4/415, 317, 320

[56] References Cited

U.S. PATENT DOCUMENTS

| | | | |
|---|---|---|---|
| 1,996,325 | 4/1935 | Cox | 4/320 X |
| 2,718,012 | 9/1955 | Howe | 4/319 |
| 3,094,707 | 6/1963 | Fleming | 4/319 |
| 3,699,592 | 10/1972 | Minchak | 4/320 |
| 3,713,177 | 1/1973 | Tufts et al. | 4/320 |
| 3,878,569 | 4/1975 | Peirish, Jr. et al. | 4/319 |
| 4,131,959 | 1/1979 | Albertassi et al. | 4/319 |
| 4,170,798 | 10/1979 | Krumdieck | 4/319 |
| 4,333,185 | 6/1982 | Heinze et al. | 4/319 |
| 4,377,874 | 3/1983 | Tufts | 4/320 |
| 4,433,444 | 2/1984 | Ragot | 4/319 |

*Primary Examiner*—Henry K. Artis

*Attorney, Agent, or Firm*—Robert T. Gammons

[57] ABSTRACT

A toilet system comprising a bowl, a treating chamber, a trap connecting the bowl to the treating chamber, said trap containing a bypass to a waste pipe, a conductor connecting the treating chamber to the waste pipe, a macerator in the treating chamber for macerating effluent delivered into the treating chamber, a worm pump in the treating chamber for evacuating effluent from the bowl into the treating chamber and discharging the treated effluent into the waste pipe, a valve connected to the bowl for supplying flush water thereto and control means operable to initiate operation of the pump followed by operation of the valve and stop the pump prior to closing of the valve and wherein, in the event the pump is disabled, discharge from the bowl can be effected through the bypass by delivery of fluid into the bowl.

8 Claims, 9 Drawing Figures

WATER SAVING TOILET SYSTEM

BACKGROUND OF INVENTION

In my U.S. Pat. No. 4,333,185, dated June 8, 1982, there is shown and described a water saving toilet system. The system herein illustrated is similar in many respects to that shown in the aforesaid patent, but improved in certain aspects, particularly in that it is provided with improved pump means for evacuating the bowl, with improved bypass means for bypassing the effluent from the bowl in the event of pump failure, with improved drive means for driving both the macerator and pump from a common motor, and improved construction such as to enable dismantling the macerator and motor from the treating chamber easily and quickly to permit cleaning and/or repair.

SUMMARY OF INVENTION

As herein illustrated, the toilet system comprises a toilet bowl having at the bottom a discharge opening, a treating chamber having an intake opening, a conductor connecting the discharge opening of the bowl to the inlet opening of the treating chamber, a macerator in the chamber, means in the chamber for discharging treated effluent therefrom into the waste pipe, a motor, means drivably connecting the macerator and discharge pump to the motor for effecting simultaneous operation of the macerator and motor, a valve connecting the bowl to a source of water operable to admit water to the bowl and means for sequencing operation of the valve and motor to initiate operation of the discharge pump followed by operation of the valve to supply flush water to the bowl, terminate operation of the discharge pump and then close the valve. The discharge pump is a worm pump provided with an intake opening in communication with the interior of the treating chamber and a discharge opening in communication with the waste pipe. The means connecting the bowl to the treating chamber is a trap provided with a vertical leg, the lower end of which is connected to the discharge chamber and there is a bypass conductor connecting the vertical leg of the trap to the waste pipe containing a valve characterized in that it is supported in a position such that it is normally held closed by gravity. Desirably, the treating tank is provided with a removably attached cover at the top provided with spaced, parallel, vertically-positioned bearing sleeves. There are shafts journaled in said sleeves which extend through the cover member into the treating chamber to which the macerator blade and pump are connected. There are pulleys fixed to the shafts externally of the treating tank, a belt entrained about the shafts and a coupling connecting one of the shafts to a drive motor by means of which the two shafts are driven simultaneously.

The invention will now be described in greater detail with reference to the accompanying drawings, wherein.

Figure 1:
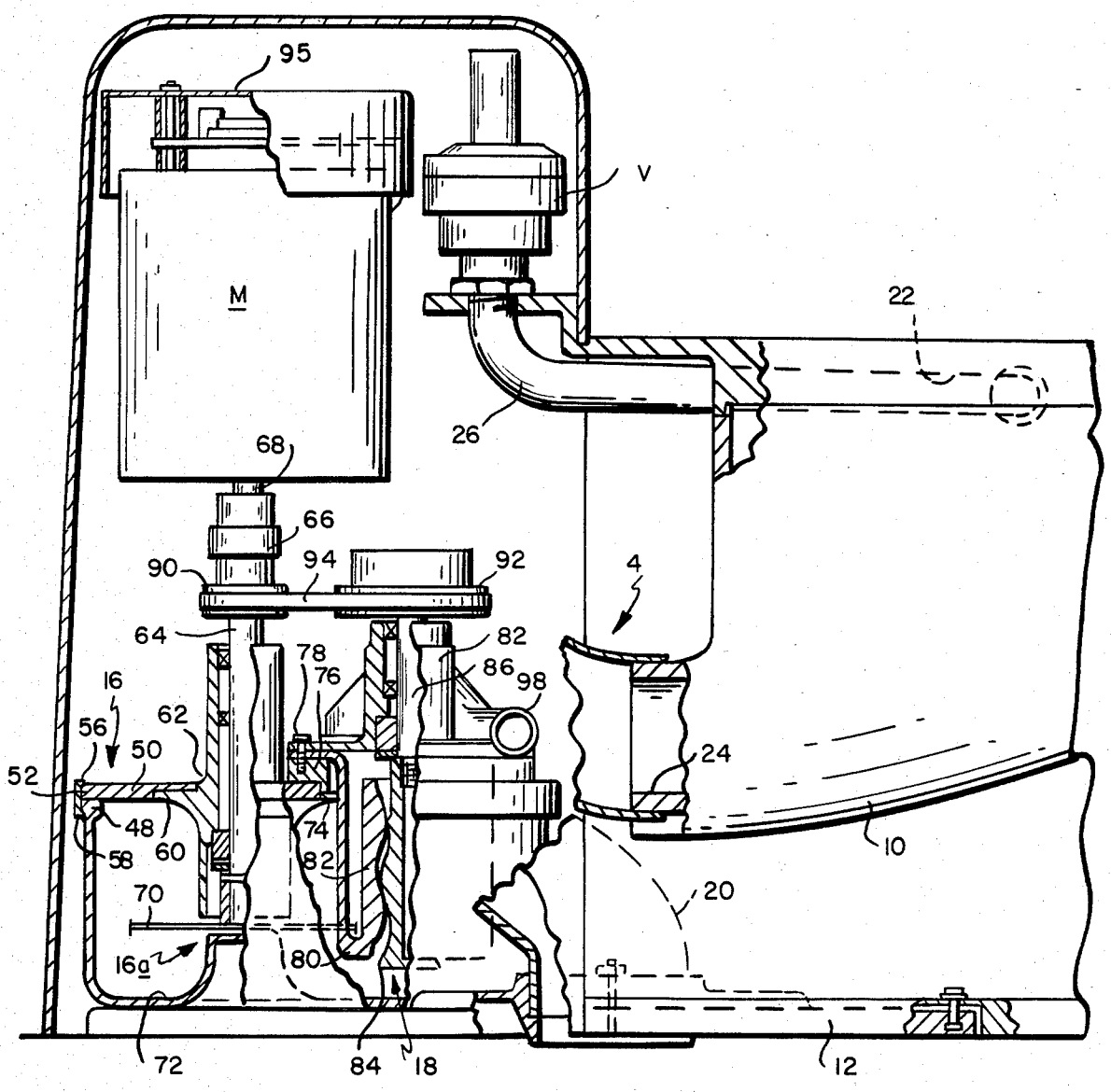
FIG. 1 is a side elevation partly in section.

Referring to the drawings, FIG. 1, there is shown a toilet bowl 10 supported on a suitable base 12, to which flush water is supplied by a solenoid-operated valve V and from which effluent is discharged through a trap 14 into a treating chamber 16 where it is macerated by a macerator 16*a* and then pumped by means of a pump 18 through a discharge conductor 20 to a soil pipe.

Figure 2:
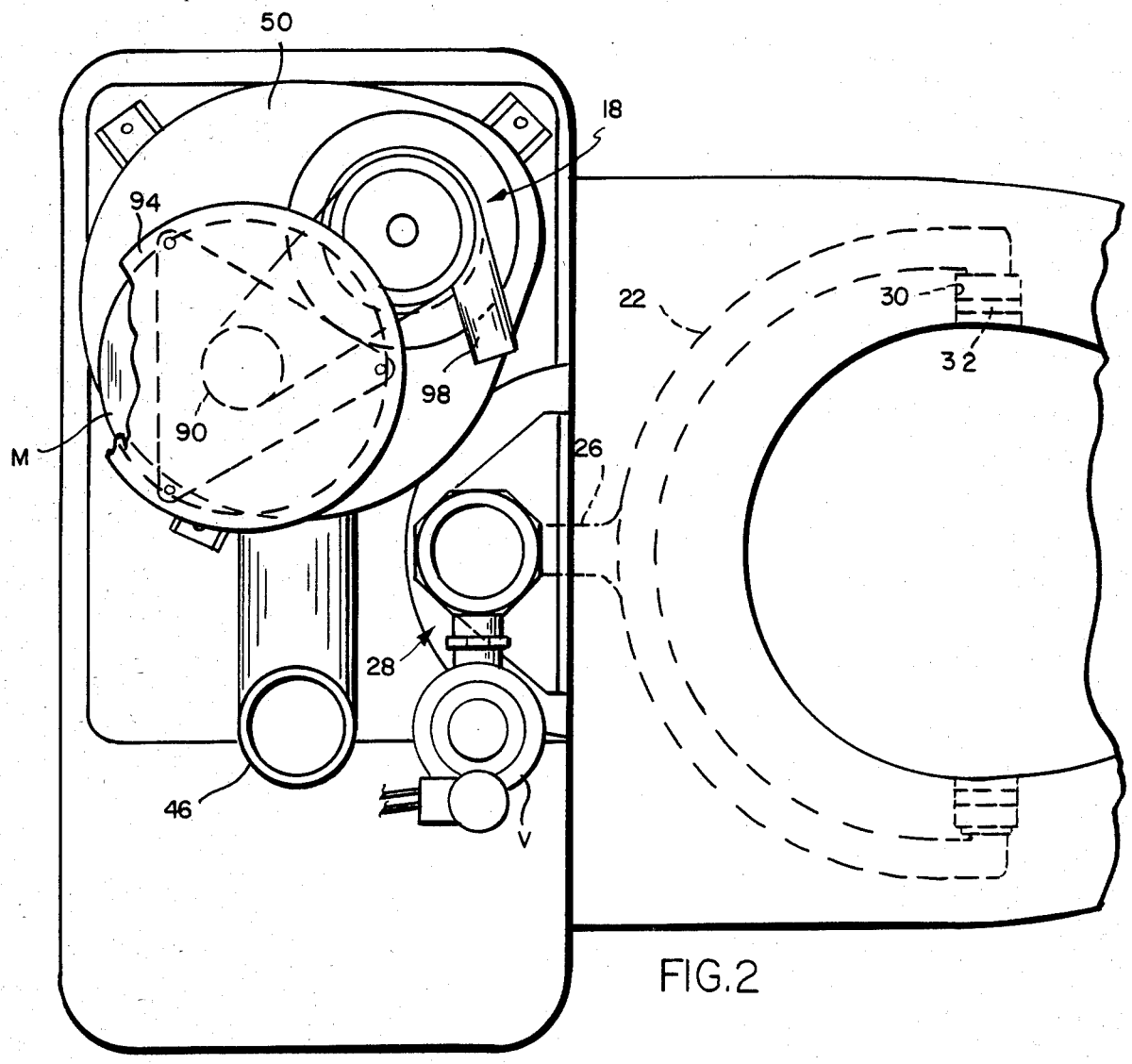
FIG. 2 is a top plan view.
Figure 2A:
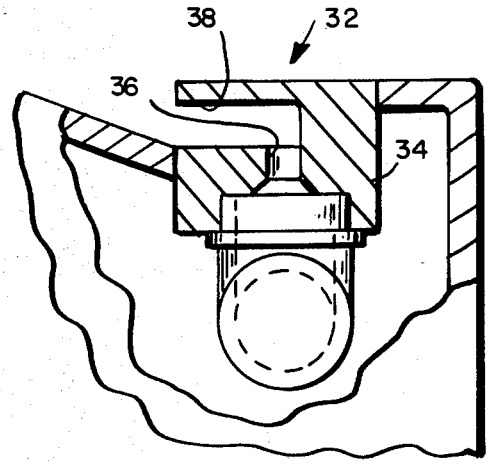
FIG. 2A is a fragmentary section of a spray head nozzle.

The toilet bowl 10 is of generally conventional configuration, has at the top a cored passage 22 which, as shown in FIG. 2, extends peripherally around the rear half of the bowl, through which flush water is delivered to the bowl for flushing, and a discharge opening 24 at the bottom through which effluent is discharged. The rear end of the cored passage is connected by a feeder tube 26 and suitable plumbing 28 to the valve V which, in turn, is connected to a water supply, not shown, so that operation of the valve will supply flush water to the cored passage. The forward ends of the cored passage terminate diametrically opposite each other approximately halfway between the front and rear ends of the bowl in openings 30-30 within which there are fixed spray nozzles 32—32 through which water delivered into the cored passage is ejected downwardly on the surface of the bowl. The nozzles 32—32 comprise, FIG. 2A, cylindrical plugs 34 containing ports 36 which are in communication with the cored passage 22 and downwardly-open slots 38 designed to eject the flush water downwardly in fan shape against the surface of the bowl so as to wash the surface down.

Figure 5:
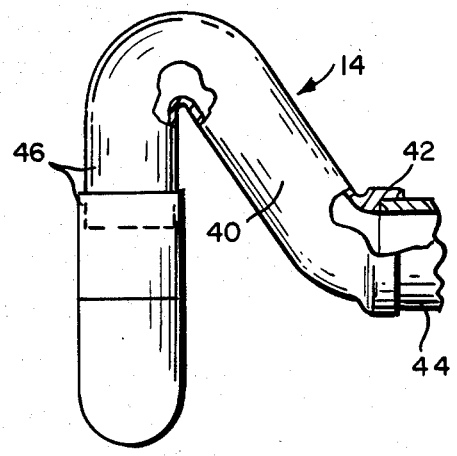
FIG. 5 is a fragmentary elevation with a portion in section of the trap pipe from the bowl to the treating chamber.

The trap 14 for conducting the effluent from the bowl to the treating chamber, as shown in FIG. 5, has an upwardly-inclined leg 40, the lower end of which is flanged at 42 to fit over an extension 44 defining the opening 24, and a vertical leg 46 connected at its upper end to the inclined leg 40 and at its lower end to the treating tank 16.

The treating chamber 16 is mounted on the supporting structure for the bowl behind the bowl, is of generally circular cross section, is closed at the bottom, and has an open top, peripherally of which there is a beveled rim 48. A cover plate 50 having a beveled edge 52 is mounted on the rim 48 and detachably secured thereto by a locking band 54, the upper and lower edges 56 and 58 of which overlap the beveled portions of the rim and edge. The locking band 54 provides for easy removal of the cover plate from the treating chamber. The cover plate supports the macerator 16*a*, the pump 18 and the drive means therefor. To this end, the cover plate 50 is provided with a top opening 60 in which there is mounted a vertical bearing assembly 62 which supports a shaft 64 in a vertical position with a portion extending above the treating chamber and a portion extending into the treating chamber. The portion of the shaft 64 extending above the treating chamber is fixed by a coupling 66 to the drive shaft 68 of a motor M. The portion of the shaft 64 extending into the treating chamber has fixed to it a macerator blade 70 disposed in a horizontal position at right angles to the axis of the shaft. Below the macerator blade, the bottom of the treating chamber is structured to provide an annular toroidal surface 72. The blade 70 and the subjacent toroidal surface 72 provide for hydraulic attrition of effluent delivered into the treating chamber. The macerator operates by hydraulic attrition rather than cutting to disperse and particu- late the solids in the effluent.

The cover plate 50 is also provided with an opening 74 for receiving the pump assembly 18 and the latter is mounted in the opening by means of a ring 76 fastened by bolts 78 to the top plate and comprises a sealed housing 80 within which there is a stator 82 and a rotor 84. The upper end of the rotor is fixed to a shaft 86 journaled in a bearing 88 mounted on the ring 78. The stator and rotor 82 and 84 constitute, in conjunction, a worm pump.

A pulley 90 is fixed to the upper end of the shaft 86, a pulley 92 is fixed to the upper end of the shaft 64, and a belt 94 is trained about the pulleys so that the motor M drives the macerator and the pump simultaneously. A control module 94 is mounted at the top of the motor M.

The pump 18 has an intake port 96 within the treating chamber and a discharge port 98 externally of the chamber and the latter is connected by a coupling 100 to one end of a conductor 102, the other end of which is connected by a slip joint 104 to the discharge conductor 20 which, as previously mentioned, is connected to a waste pipe.

Figure 3:
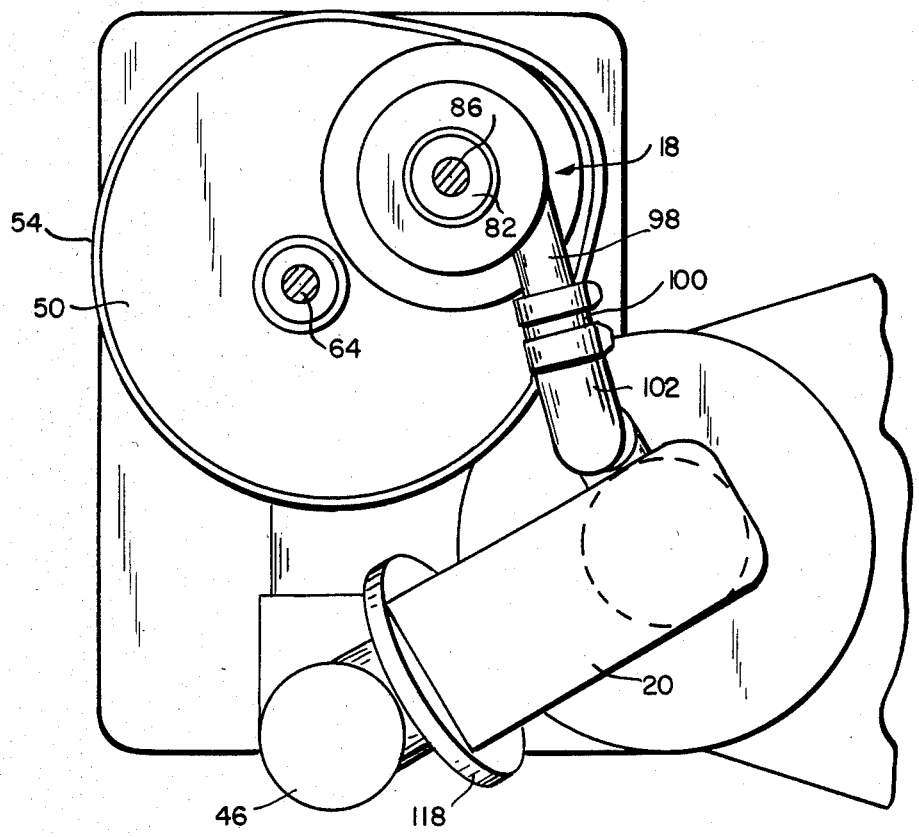
FIG. 3 is a plan view, of the treating chamber showing the bypass.
Figure 4:
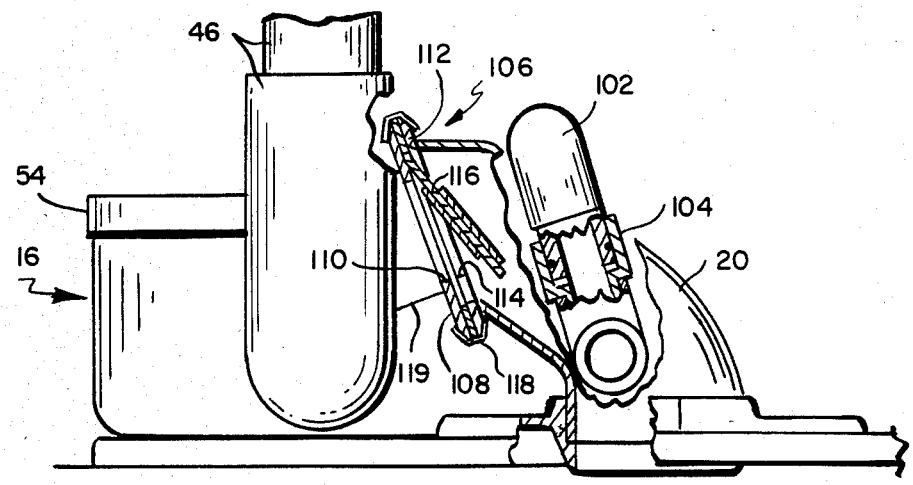
FIG. 4 is an elevation of the treating chamber showing the bypass partly in section.
Figure 6:
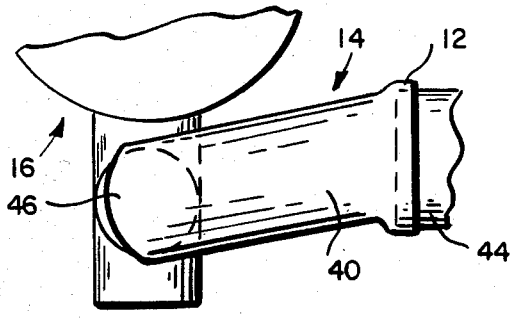
FIG. 6 is a top view of FIG. 5.

As shown in FIGS. 3 and 4, the discharge conductor 20 is connected at one end directly to the vertical leg of the trap by means of a valve assembly 106 comprising a beveled plate 108 which defines an opening 110, a plate 112 which defines an opening 114 and a flexible valve member 116 positioned therebetween and clamped in place by a circumferential clamping ring 118. The plate 108 is fixed to a branch pipe 119 stemming from the leg 46, the axis of which is inclined upwardly with respect to the vertical axis of the leg 46 so that the plate 108 slopes downwardly at a diverging angle with respect to the axis of the vertical leg. The plate 112 is fixed to the discharge pipe 20 at an angle such as to be parallel to the plate 108. As thus constructed, the valve assembly slopes downwardly and divergently with respect to the axis of the vertical leg of the trap. The flexible valve member 116 is arranged to open inwardly with respect to the conductor 20 by a pressure head within the vertical leg of the trap and to close by gravity in the absence of a head in the vertical portion of the trap. Normally, when the pump is in operation, it produces a low pressure in the vertical portion of the trap so that the low pressure, in conjunction with the gravitational disposition of the valve member 116, ensures that the valve will be held closed under normal conditions. An angular disposition of the valve is of importance to prevent siphoning of the effluent from the vertical leg of the trap when the system is at rest. When the system is in use and, for some reason, the pump becomes disabled, a pressure head developed in the vertical leg of the trap will open the valve 116 and allow the effluent to flow directly through the conductor 20 to the waste pipe. The pressure head can be provided by dumping water into the bowl or, if the valve V is operative, supplying water to the bowl through the valve.

The system in normal operation is sequenced by the control circuitry 94 so that the discharge pump 18 is started first, followed by energization of the solenoid to open the valve V for supplying flush water to the bowl. When the flushing cycle is completed, the discharge pump stops first followed by closing of the valve V. The macerator is in operation during the entire time that the pump is in operation.

Figure 7:
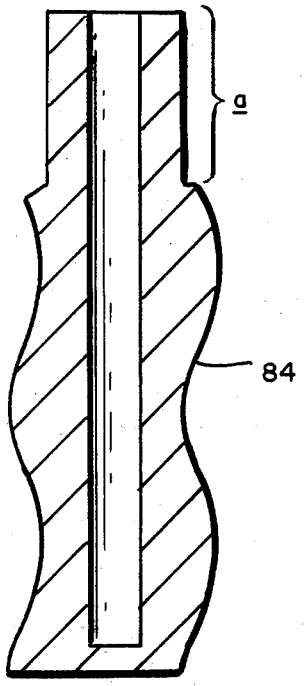
FIG. 7 is a plan view of the pump rotor.

In prior toilet systems of this kind, diaphragm and gear pumps have been used for effecting discharge of effluent. However, in accordance with this invention, it has been found that a screw pump is considerably more satisfactory and effective insofar as the flush cycle is concerned. The stator 82 is comprised of flexible rubber and the rotor is plastic. In order to reduce the friction load of the plastic rotor in the flexible rubber stator, a portion of the worm at one end has been reduced to the root diameter of the worm. As herein illustrated, FIG. 7, the rotor 84, which is comprised of Bakelite, is 4.28 inches axial length. The diameter of the worm is 1.12 inches and has a helix angle of 25 degrees with a lead of 1.648 and at one end a portion a 1.12 inches in length reduced to a uniform diamter of 0.0875 inches. By reducing the portion a at the one end to the root diameter of the worm, the friction between the rotor and stator can be materially reduced, thus reducing the power input necessary to drive the pump.

Figure 8:
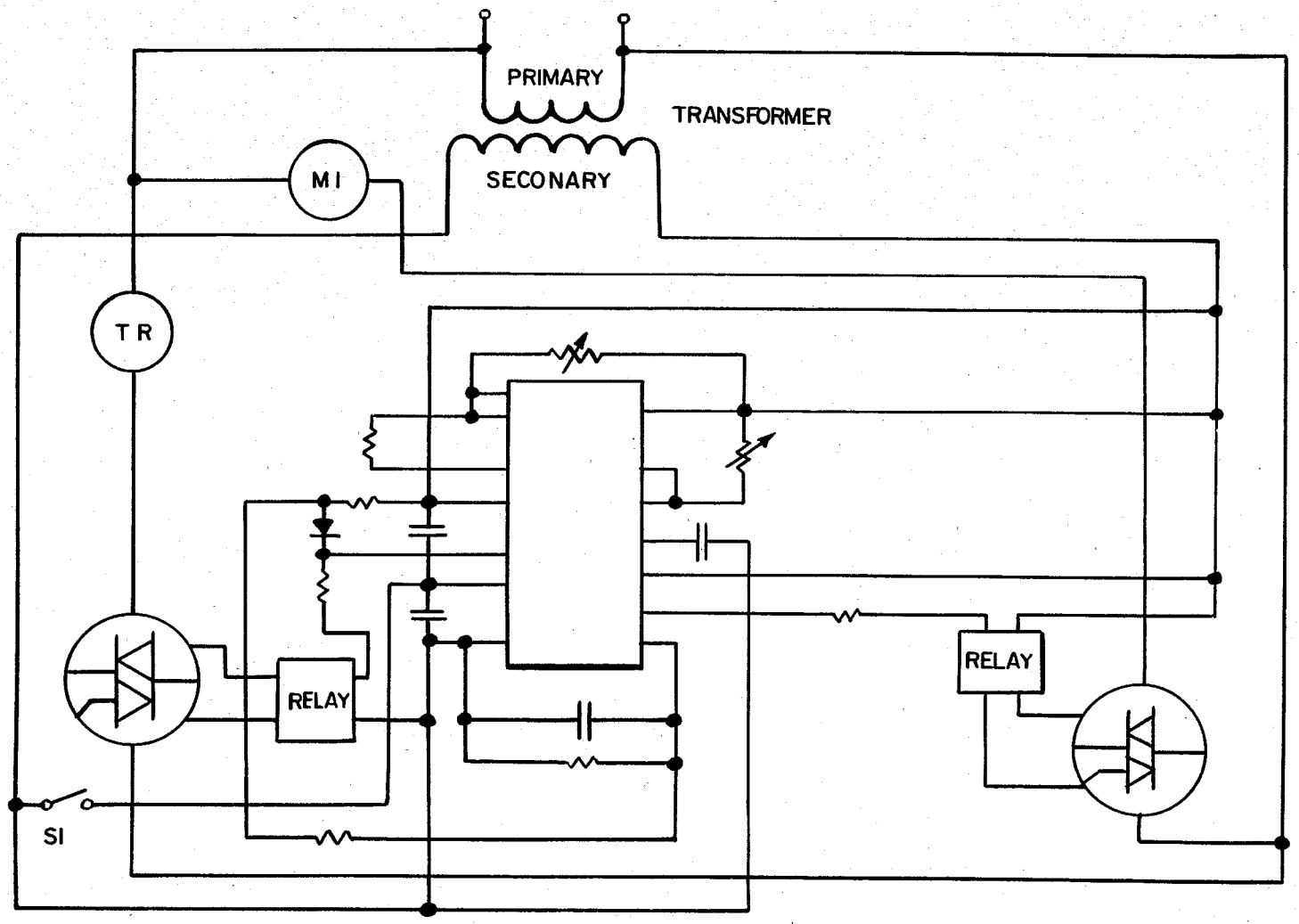
FIG. 8 is a control circuit diaphragm for controlling the sequence of operation.

FIG. 8 is the control circuit diagram which provides for sequencing the operation of the valve V and pump 18 so as to start the pump before opening the valve V and to stop the pump before closing the valve. In the circuit, there is shown a switch S for energizing the circuit, a motor $M_1$ for driving the macerator and pump, a solenoid TR for activating the valve V and a transformer comprising primary and secondary windings so labeled.

It should be understood that the present disclosure is for the purpose of illustration only and includes all modifications or improvements which fall within the scope of the appended claims.

What is claimed is:

1. A toilet system comprising a toilet bowl having at the bottom a discharge opening, a treating chamber having an intake opening, a conductor connecting the discharge opening of the bowl to the intake opening of the treating chamber, a macerator in the treating chamber, means in the treating chamber for discharging treated effluent therefrom into a waste pipe, a motor, means drivably connecting the macerator and discharge pump to the motor for effecting simultaneous operation of the macerator and discharge pump, a valve connecting the bowl to a source of water operable to admit water to the bowl and means for sequencing operation of the valve and the motor to initiate operation of the discharge pump followed by operation of the valve to supply flush water to the bowl, terminate operation of the discharge pump and then close the valve.

2. A toilet system according to claim 1 wherein the means for effecting discharge is a worm pump.

3. A toilet system according to claim 1 comprising a trap connecting the bowl to the treating chamber through which effluent is pumped by the worm pump located in the treating chamber and a bypass conductor connected at one end to the trap and at its other end to the waste pipe containing a valve held closed by low pressure developed in the treating chamber by the pump which is free to open in the event of a pressure head in the trap.

4. A toilet system according to claim 1 wherein the trap has a vertical leg to the lower end of which is connected the treating chamber and there is a bypass conductor connecting the vertical leg of the trap to a waste pipe containing a valve characterized in that it is supported in the bypass at an angle to the axis of the leg such that it is gravitationally held in a closed position.

5. A toilet system according to claim 1 wnerein the trap has a vertical leg, the lower end of which is connected to the treating chamber and there is a bypass conductor connecting the vertical leg of the trap to the waste pipe containing a valve assembly comprising a valve seat defining a valve controlled opening in the bypass and a valve member supported for engagement with the seat to close the opening characterized in that the assembly is positioned at an angle such that the valve member is normally held closed by gravity.

6. A toilet system according to claim 1 wherein the bowl has a cored passage around a portion thereof at the top connected by a coupling to the inlet valve and at diametrically-opposite sides spray head nozzles in communication with the cored passage through which flush water is discharged into the bowl.

7. A toilet system according to claim 1 wherein the treating chamber is provided with a peripheral bead and a top plate provided with a peripheral bead and there is a band positioned about the peripheral beads for detachably securing the top plate to the top of the treating chamber and wherein the macerator and pump are mounted on the cover plate such that they can be moved as a unit from the treating chamber for cleaning and/or repair.

8. A toilet system according to claim 6 wherein bearings are mounted on the top plate, shafts are positioned in the bearings for, respectively, the macerator and the pump, pulleys are fixed to the shafts, a belt is entrained about the pulleys and a coupling drivably connects one of the shafts to a drive motor.

* * * * *